US009520122B2

(12) United States Patent
Kang et al.

(10) Patent No.: US 9,520,122 B2
(45) Date of Patent: Dec. 13, 2016

(54) AUDIO APPARATUS AND CONTROLLING METHOD THEREOF

(71) Applicant: Hyundai Motor Company, Seoul (KR)

(72) Inventors: Hyo Sup Kang, Seoul (KR); Jin Ook Yoo, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 227 days.

(21) Appl. No.: 14/313,391

(22) Filed: Jun. 24, 2014

(65) Prior Publication Data

US 2015/0154951 A1 Jun. 4, 2015

(30) Foreign Application Priority Data

Dec. 3, 2013 (KR) ..... 10-2013-0149248

(51) Int. Cl.
*G10K 11/178* (2006.01)

(52) U.S. Cl.
CPC ..... *G10K 11/1786* (2013.01); *G10K 2210/12* (2013.01); *G10K 2210/1282* (2013.01); *G10K 2210/3019* (2013.01)

(58) Field of Classification Search
USPC ... 381/71.4, 71.8, 71.1, 72, 73.1; 455/456.1; 361/77
See application file for complete search history.

(56) References Cited

U.S. PATENT DOCUMENTS

2007/0036367 A1 2/2007 Ko
2008/0240457 A1* 10/2008 Inoue ..... G10K 11/178 381/71.4

FOREIGN PATENT DOCUMENTS

| | | |
|---|---|---|
| JP | 2007-019980 A | 1/2007 |
| KR | 10-2006-0075541 | 7/2006 |
| KR | 10-2007-0050180 | 5/2007 |
| KR | 10-2007-0075664 | 7/2007 |
| KR | 10-2011-0123339 | 11/2011 |

* cited by examiner

*Primary Examiner* — MD S Elahee
(74) *Attorney, Agent, or Firm* — Mintz Levin Cohn Ferris Glovsky and Popeo, P.C.; Peter F. Corless

(57) ABSTRACT

An audio apparatus and method are provided. The method includes receiving, by a controller, first audio data and second audio data and processing the first audio data and the second audio data to generate first audio signals and second audio signals. Further, reverse phase signals of the first audio signals are generated by the controller. A first group of the plurality of audio outputting units output the first audio signals and a second group of the plurality of audio outputting units output the second audio signals and the reverse phase signals of the first audio signals.

13 Claims, 7 Drawing Sheets

| AUDIO OUTPUTTING UNIT | KIND OF AUDIO SIGNAL | OUTPUT LEVEL |
|---|---|---|
| 1 | A | 10 |
| 2 | A | 7 |
| 3 | A | 10 |
| 4 | A | 10 |
| 5 | A | 7 |
| 6 | B | 10 |
| | A' | 5 |
| 7 | B | 10 |
| | A' | 7 |
| 8 | B | 10 |
| | A' | 5 |
| 9 | B | 10 |
| | A' | 7 |

Fig.5

| AUDIO OUTPUTTING UNIT | KIND OF AUDIO SIGNAL | OUTPUT LEVEL |
|---|---|---|
| 1 | A | 10 |
| | B' | 7 |
| 2 | A | 10 |
| | B' | 5 |
| 3 | A | 10 |
| | B' | 7 |
| 4 | A | 10 |
| | B' | 7 |
| 5 | A | 10 |
| | B' | 5 |
| 6 | B | 10 |
| | A' | 5 |
| 7 | B | 10 |
| | A' | 7 |
| 8 | B | 10 |
| | A' | 5 |
| 9 | B | 10 |
| | A' | 7 |

Fig.6

AUDIO APPARATUS AND CONTROLLING METHOD THEREOF

CROSS-REFERENCE TO RELATED APPLICATION

This application is based on and claims the benefit of priority to Korean Patent Application No. 10-2013-0149248, filed on Dec. 3, 2013 in the Korean Intellectual Property Office, the disclosure of which is incorporated herein in its entirety by reference.

TECHNICAL FIELD

The present disclosure relates to an audio apparatus that reproduces an audio signal to be appropriate for a listening situation using a noise canceling technology, and a controlling method thereof.

BACKGROUND

In accordance with the development of an electronic technology, various types of electronic products have been developed. A multimedia reproducing apparatus such as an audio video navigation (AVN) has been mounted within a vehicle, such that a driver may enjoy various contents while driving the vehicle. Particularly, an audio apparatus mounted within the vehicle has been used in various fields such as listening of the radio, listening of songs, a voice call in connection with a smart phone, or the like, while driving the vehicle.

However, when the driver listens to music or makes the voice call within the vehicle, occurrence of noise due to the driving of the vehicle may be problematic. Therefore, a technology of minimizing an influence of the noise due to the driving of the vehicle and allowing an original sound to be vividly heard using a noise canceling technology has been developed. An audio apparatus according to the related art mounted within a vehicle may reproduce only one audio signal through a plurality of speakers. In other words, according to the related art, multiple speakers could be used independently to allow users to listen to different music for example.

SUMMARY

The present disclosure provides an audio apparatus configured to listen to different audio signals based on positions of seats within a vehicle, and a controlling method thereof.

According to an exemplary embodiment of the present disclosure, an audio apparatus may include: a receiving unit configured to receive first audio data and second audio data; a signal processing unit configured to process the first audio data and the second audio data to generate first audio signals and second audio signals; a reverse phase signal generating unit configured to generate reverse phase signals of the first audio signals; a plurality of audio outputting units; and a controller configured to operate the plurality of audio outputting units so that some of the plurality of audio outputting units output the first audio signals and others thereof output the second audio signals and the reverse phase signals of the first audio signals.

Output levels of the reverse phase signals of the first audio signals may be lower than those of the first audio signals. In addition, output levels of the reverse phase signals of the first audio signals may be different from each other based on positions of the audio outputting units outputting the reverse phase signals of the first audio signals within the vehicle. The audio outputting units may be configured to generate reverse phase signals of the second audio signals, and the audio outputting units outputting the first audio signals may be configured to output the first audio signals and the reverse phase signals of the second audio signals together.

The audio apparatus may further include a display unit configured to display types of audio signals output from each of the plurality of audio outputting units. In addition, the audio apparatus may further include an inputting unit configured to receive a user command for changing audio signals output from the plurality of audio outputting units. The audio apparatus may further include a storing unit configured to store set information in which types and output levels of audio signals output from each of the plurality of audio outputting units are set.

According to another exemplary embodiment of the present disclosure, a controlling method of an audio apparatus may include: receiving first audio data; processing the first audio data to generate first audio signals; outputting the first audio signals to a plurality of audio outputting units; receiving second audio data; processing the second audio data to generate second audio signals; generating reverse phase signals of the first audio signals; and outputting the first audio signals to some of the plurality of audio outputting units (e.g., to a first group of the plurality of audio outputting units) and outputting the second audio signals and the reverse phase signals of the first audio signals to others of the plurality of audio outputting units (e.g., to a second group of the plurality of audio outputting units).

In the outputting of the reverse phase signals of the first audio signals, the reverse phase signals of the first audio signals may be output at output levels lower than those of the first audio signals. The controlling method of an audio apparatus may further include: generating reverse phase signals of the second audio signals; and outputting the first audio signals and the reverse phase signals of the second audio signals to the audio outputting units outputting the first audio signals. In addition, the controlling method of an audio apparatus may further include: receiving a user command for changing audio signals output from the plurality of audio outputting units; and changing the audio signals output from the plurality of audio outputting units based on the user command. The controlling method of an audio apparatus may further include: receiving a user command for selecting an output mode in which types and output levels of audio signals output from each of the plurality of audio outputting units are set; and changing the audio signals output from the plurality of audio outputting units based on the output mode.

BRIEF DESCRIPTION OF THE DRAWINGS

The above and other objects, features and advantages of the present disclosure will be more apparent from the following detailed description taken in conjunction with the accompanying drawings.

FIGS. 5 and 6 are exemplary diagrams showing set information according to an exemplary embodiment of the present disclosure.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit/controlling unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit/controlling unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items.

Hereinafter, the present disclosure will be described in detail with reference to the accompanying drawings.

Figure 1:
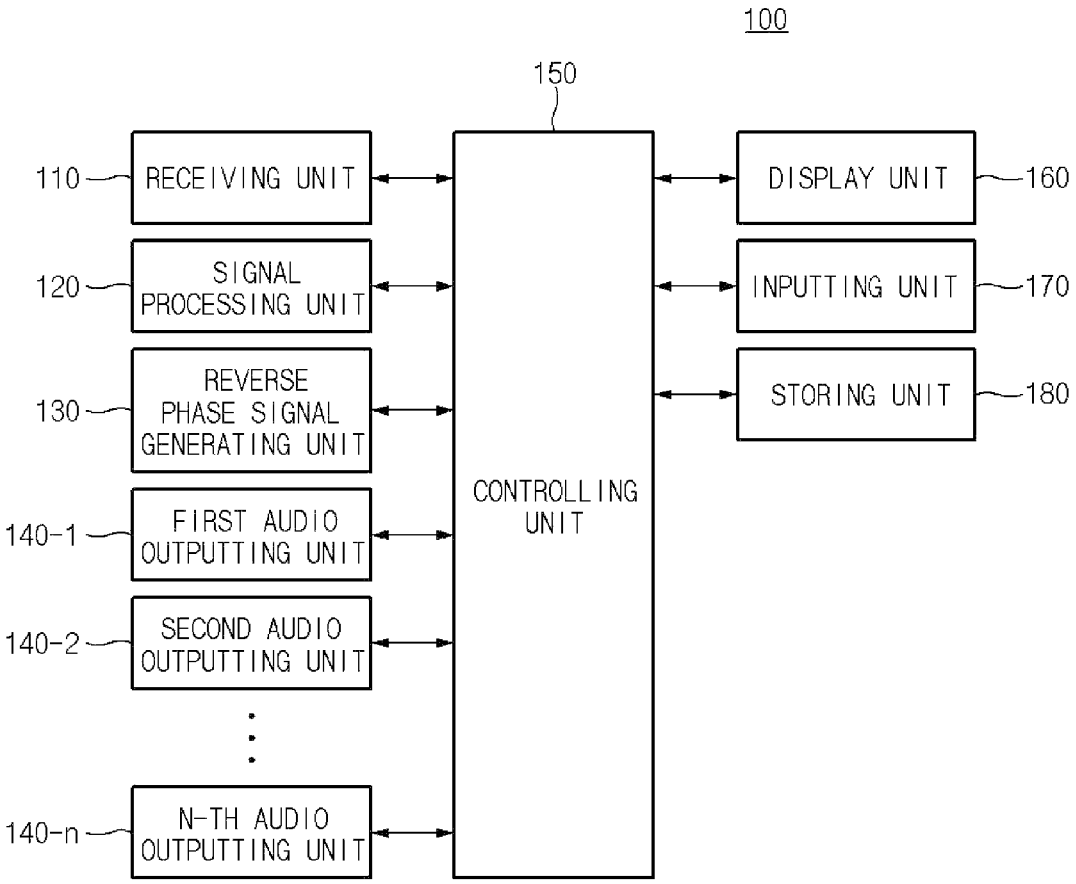
FIG. 1 is an exemplary block diagram showing a configuration of an audio apparatus for a vehicle according to an exemplary embodiment of the present disclosure.

FIG. 1 is an exemplary block diagram showing a configuration of an audio apparatus for a vehicle according to an exemplary embodiment of the present disclosure. Referring to FIG. 1, an audio apparatus for a vehicle may be configured to include a receiving unit 110, a signal processing unit 120, a reverse phase signal generating unit 130, a plurality of audio outputting units 140-1, 140-2, . . . , **140-*n*, a controller 150, a display unit 160, an inputting unit 170, and a storing unit 180. The controller 150 may be configured to execute the receiving unit 110, the signal processing unit 120, the reverse phase signal generating unit 130, the plurality of audio outputting units 140-1, 140-2, . . . , 140-*n*, the display unit 160, the inputting unit 170, and the storing unit 180**

The receiving 110 may be configured to receive audio data and more specifically, may be configured to receive first audio data and second audio data. The receiving unit 110 may be configured to receive the audio data from various sources. For example, the receiving unit 110 may be configured to receive the audio data from a broadcasting station that provides broadcasting contents via a broadcasting network or a web server that provides contents using the Internet. In addition, the receiving unit 110 may be configured to receive the audio data from various recording media disposed within or connected to the audio apparatus 100 for a vehicle. The recording media may include various types of recording media such as a compact disk (CD), a digital versatile disk (DVD), a memory card, a universal serial bus (USB) memory, and the like. In addition, the receiving unit 110 may also be connected to a portable terminal apparatus such as a smart phone to receive the audio data.

The receiving unit 110 may be implemented in various forms based on a scheme of receiving the audio data. For example, when the receiving unit 110 receives the audio data from the broadcasting station, the receiving unit 110 may include components such as an antenna, a tuner, and the like. In addition, when the receiving unit 110 receives the audio data from the web server, the portable terminal apparatus, or the USB memory, the receiving unit 110 may be implemented by various communication interfaces such as a wireless local area network (WLAN), Bluetooth, a near field communication (NFC), a universal serious bus (USB), and the like. In addition, the receiving unit 110 may be configured to receive the first audio data and the second audio data from different sources. For example, the first audio data may be voice call data received from the smart phone, and the second audio data may be sound source data received from the USB memory.

The signal processing unit 120 may be configured to process (e.g., signal-process) the first and second audio data received by the receiving unit 110 to generate first and second audio signals. In particular, the signal processing unit 120 may be configured to perform signal processing such as decoding, or the like, on the audio data received by the receiving unit 110 to generate audio signals having a reproducible form. In addition, the signal processing unit 120 may include a plurality of signal processing modules each configured to process the first and second audio signals.

The reverse phase signal generating unit 130 may be configured to generate reverse phase signals of the first audio signals generated by the signal processing unit 120. In particular, the reverse phase signal may mean an audio signal having about the same amplitude as that of a specific audio signal and having an opposite phase to that of the specific audio signal. In other words, when the audio signal and the reverse phase signal are output together, vibrations of the audio signal are offset by the reverse phase signal, such that no sound (e.g., minimal sound) may be heard. The reverse phase signal generating unit 130 may also be configured to generate reverse phase signals of the second audio signals generated by the signal processing unit 120. The plurality of audio outputting units 140-1, 140-2, . . . , **140-*n* may be configured to output at least one of the audio signals and the reverse phase signals generated by the signal processing unit 120 and the reverse phase signal unit 130. Each of the plurality of audio outputting units 140-1, 140-2, . . . , 140-*n*** may be implemented by a speaker mounted within the vehicle. The audio outputting units may be speakers or other devices configured to output sound.

The controller 150 may be configured to operate the audio apparatus 100 for a vehicle. Particularly, the controller 150 may be configured to operate the plurality of audio outputting units 140-1, 140-2, . . . , **140-*n* so that some of the plurality of audio outputting units 140-1, 140-2, . . . , 140-*n* (e.g., a first group) may be configured to output the first audio signals and others thereof (e.g., a second group) may be configured to output the second audio signals and the reverse phase signals of the first audio signals. The signals output from each of the plurality of audio outputting units 140-1, 140-2, . . . , 140-*n* may be changed based on a user situation. The signals output from each of the plurality of audio outputting units 140-1, 140-2, . . . , 140-*n* depending on specific situations will be described with reference to FIGS. 2 to 4**.

Figure 2:
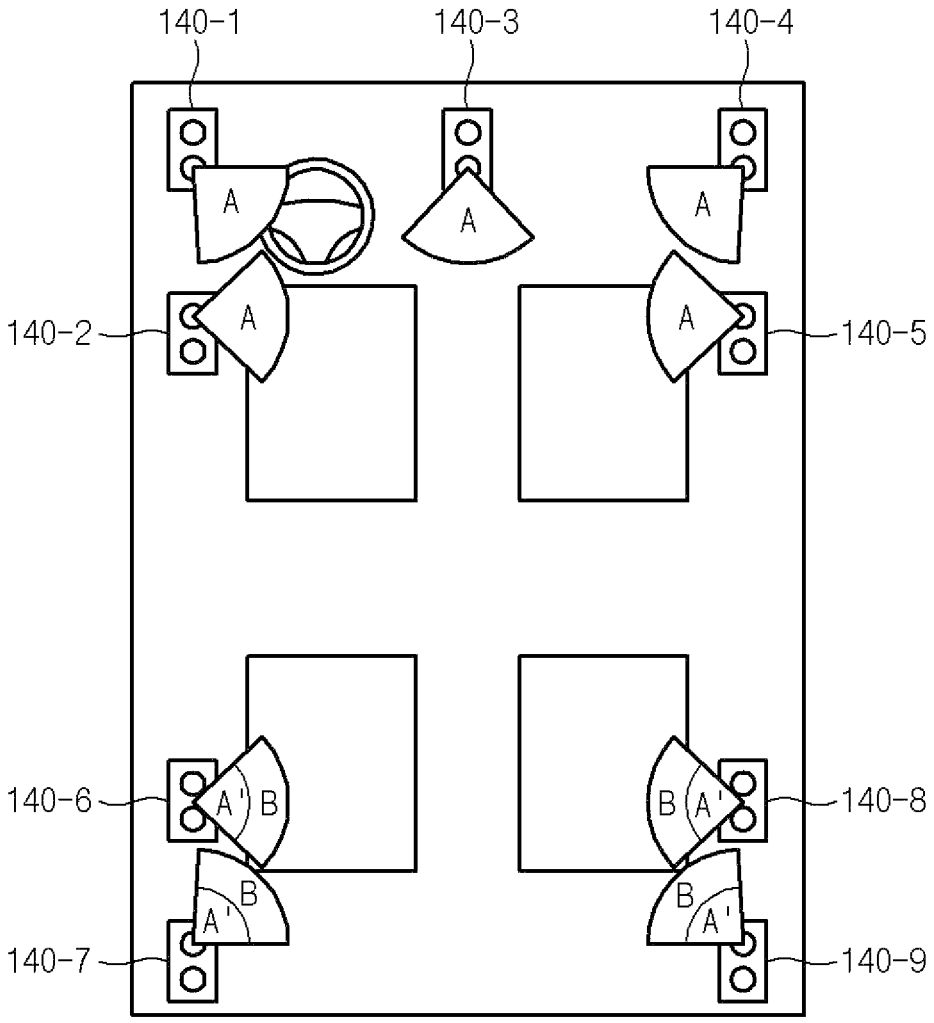
FIG. 2 is an exemplary diagram for describing types of signals output from each of a plurality of audio outputting unit according to an exemplary embodiment of the present disclosure.

FIG. 2 is an exemplary diagram for describing types of signals output from each of a plurality of audio outputting unit according to an exemplary embodiment of the present disclosure. Particularly, FIG. 2 shows an example of a case in which a user seated on a front seat of the vehicle makes a telephone call (e.g., connects externally via the telephone) and a user seated on a rear seat of the vehicle listens to music. Referring to FIG. 2, the plurality of audio outputting units 140-1, 140-2, . . . , **140-*n* may be positioned within the vehicle. In addition, some 140-1, 140-2, . . . , 140-5 of the plurality of audio outputting units may be configured to output the first audio signals (voice call signals) A, and others 140-6, 140-7, . . . , 140-9** thereof may be configured to output the second audio signals (sound source signals) B and reverse phase signals A' of the first audio signals.

According to FIG. 2, since the audio outputting units 140-1, 140-2, . . . , 140-5 positioned at the front seat of the vehicle output the first audio signals A, the user seated on the front seat may speak with the other party while listening to a call voice. In addition, since the audio outputting units 140-6, 140-7, . . . , 140-9 positioned at the rear seat of the vehicle output the second audio signals B, the user seated on the rear seat of the vehicle may listen to the music. Accordingly, the passengers within the vehicle may listen to different speaker outputs within the vehicle. Further, since the audio outputting units 140-6, 140-7, . . . , 140-9 positioned at the rear seat of the vehicle may be configured to output the reverse phase signals A' of the first audio signals, the call voice heard from the front seat of the vehicle may be offset According to FIG. 2, the user seated on the front seat of the vehicle may make a private call without exposing the call voice to the user seated on the rear seat of the vehicle. That is, the call may remain private without being heard from a rear seat of the vehicle. In addition, the user seated on the rear seat of the vehicle may listen to the music without being hindered by the call voice output from the front seat of the vehicle.

Figure 3:
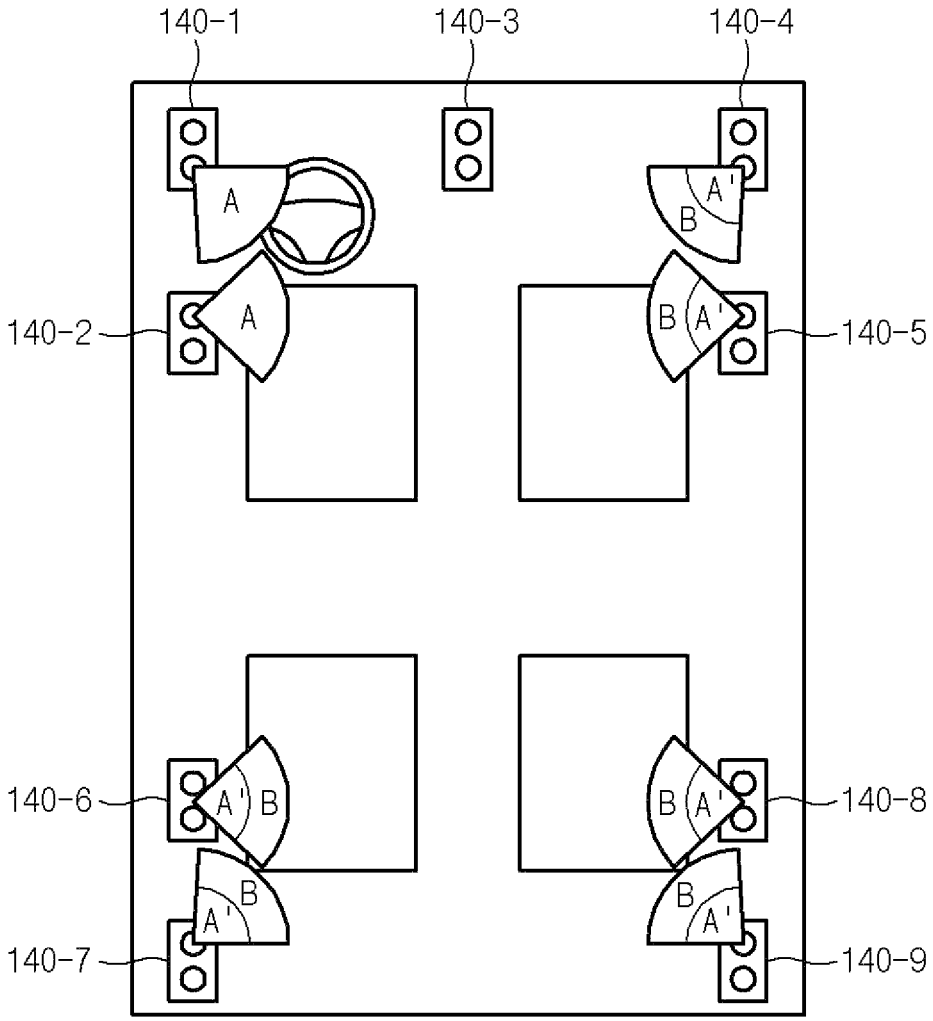
FIG. 3 is an exemplary diagram for describing types of signals output from each of a plurality of audio outputting unit according to another exemplary embodiment of the present disclosure.

FIG. 3 is an exemplary diagram for describing types of signals output from each of a plurality of audio outputting unit according to another exemplary embodiment of the present disclosure. Particularly, FIG. 3 shows an example of a case in which some of the plurality of audio outputting units in the vehicle do not output audio signals. Referring to FIG. 3, some 140-1 and 140-2 of the plurality of audio outputting units within the vehicle (e.g., a first group) may be configured to output the first audio signals (voice call signals) A, and others 140-4, 140-5, . . . , 140-9 thereof (a second group) may be configured to output the second audio signals (sound source signals) B and reverse phase signals A' of the first audio signals.

According to FIG. 3, since the audio outputting units 140-1 and 140-2 positioned at a driver's seat (e.g., a front seat) of the vehicle output the first audio signals A, the user seated on the driver's seat may speak with the other party while listening to a call voice. In addition, since the audio outputting units 140-4, 140-5, . . . , 140-9 positioned at the other seats of the vehicle output the second audio signals B, users seated on the other seats of the vehicle may listen to the music. Further, since the audio outputting units 140-4, 140-5, . . . , 140-9 positioned at the other seats of the vehicle output the reverse phase signals A' of the first audio signals, the call voice heard from the driver's seat of the vehicle may be offset.

Meanwhile, in some exemplary embodiments, some of the plurality of audio outputting units within the vehicle may not output the audio signals. For example, when the user seated on the driver's seat is listening to the call voice as shown in FIG. 3, a third audio outputting unit 140-3 positioned between the driver's seat and the seat next to the driver (e.g., a passenger seat) may not output the audio signal. According to FIG. 3, the user seated on the driver's seat of the vehicle may make a private call without exposing the call voice to the users seated on the other seats of the vehicle. In addition, the users seated on the other seats of the vehicle may listen to the music without being hindered by the call voice output from the driver's seat of the vehicle.

Figure 4:
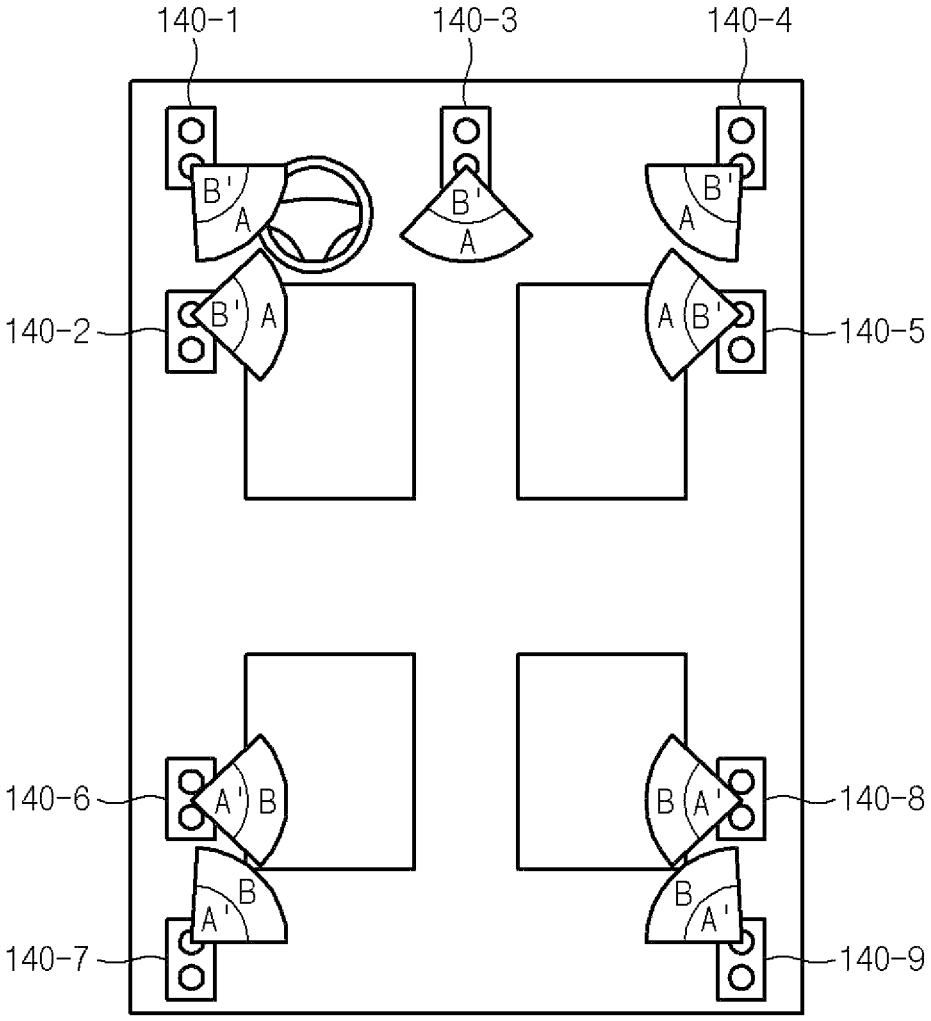
FIG. 4 is an exemplary diagram for describing types of signals output from each of a plurality of audio outputting unit according to still another exemplary embodiment of the present disclosure.

FIG. 4 is an exemplary diagram for describing types of signals output from each of a plurality of audio outputting unit according to still another exemplary embodiment of the present disclosure. Particularly, FIG. 4 shows an example of a case in which reverse phase signals of the second audio signals and the reverse phase signals of the first audio signals are output. Referring to FIG. 4, some 140-1, 140-2, . . . , 140-5 of the plurality of audio outputting units within the vehicle may be configured to output the first audio signals (voice call signals) A and reverse phase signals B' of the second audio signals, and others 140-6, 140-7, . . . , 140-9 thereof may be configured to output the second audio signals (sound source signals) B and reverse phase signals A' of the first audio signals.

According to FIG. 4, since the audio outputting units 140-1, 140-2, . . . , 140-5 positioned at the front seat of the vehicle output the first audio signals A, the user seated on the front seat may speak with the other party while listening to a call voice. In addition, since the audio outputting units 140-6, 140-7, . . . , 140-9 positioned at the rear seat of the vehicle output the second audio signals B, the user seated on the rear seat of the vehicle may listen to the music. Further, since the audio outputting units 140-1, 140-2, . . . , 140-5 positioned at the front seat of the vehicle output the reverse phase signals B' of the second audio signals, the sound source signal heard from the rear seat of the vehicle may be offset. Additionally, since the audio outputting units 140-6, 140-7, . . . , 140-9 positioned at the rear seat of the vehicle output the reverse phase signals A' of the first audio signals, the call voice heard from the front seat of the vehicle may be offset.

According to FIG. 4, the user seated on the front seat of the vehicle may make a private call without exposing the call voice to the user seated on the rear seat of the vehicle. In addition, the user seated on the front seat of the vehicle may make a call without being hindered by the sound source signal output from the rear seat of the vehicle. The user seated on the rear seat of the vehicle may listen to the music without being hindered by the call voice output from the front seat of the vehicle.

The controller 150 may be configured to adjust output levels of the audio signals and the reverse phase signals output from the plurality of audio outputting units 140-1, 140-2, . . . , **140-*n* to be different from each other. In particular, output levels of the reverse phase signals of the audio signals may be lower than those of the audio signals to prevent all of the audio signals from being offset by the reverse phase signals when the output levels of the reverse phase signals of the audio signals are equal to or greater than those of the audio signals, such that the audio signals may not be heard. In addition, the output levels of the reverse phase signals of the audio signals may be different from each other based on positions of the plurality of audio outputting units 140-1, 140-2, . . . , 140-*n* in the vehicle. For example, referring to FIG. 3, output levels of the reverse phase signals A' of the first audio signals output from the fourth audio outputting unit 140-4 and the ninth audio outputting unit 140-9** may be different from each other.

The display unit 160 may be configured to display types of the audio signals output from each of the plurality of audio outputting units 140-1, 140-2, . . . , **140-*n*. In addition, the display unit 160 may also be configured to display the output levels of the audio signals output from each of the plurality of audio outputting units 140-1, 140-2, . . . , 140-*n*. The inputting unit 170 may be configured to receive a user command for adjusting the audio apparatus 100 for a vehicle. The inputting unit 170 may be configured to receive a user command for changing the audio signals output from each of the plurality of audio outputting units 140-1, 140-2, . . . , 140-*n*. In particular, the inputting unit 170 may be configured to receive a user command for changing the types and the output levels of the audio signals output from each of the plurality of audio outputting units 140-1, 140-2, . . . , 140-*n*. In addition, the inputting unit 170 may be configured to receive a user command for selecting an output mode in which the types and the output levels of the audio signals output from each of the plurality of audio outputting units 140-1, 140-2, . . . , 140-*n*** are set.

The controller 150 may be configured to change the types and the output levels of the audio signals output from the plurality of audio outputting units 140-1, 140-2, . . . , **140-*n* based on the input user command input via the inputting unit 170. The storing unit 180 may be configured to store set information in which the types and the output levels of the audio signals output from each of the plurality of audio outputting units 140-1, 140-2, . . . , 140-*n* are set. This will be described with reference to FIGS. 5 and 6**.

FIGS. 5 and 6 are exemplary diagrams showing set information according to an exemplary embodiment of the present disclosure. Particularly, FIG. 5 shows set information that corresponds to a situation described with reference to FIG. 2, and FIG. 6 shows set information that corresponds to a situation described with reference to FIG. 4. Referring to FIGS. 5 and 6, the storing unit 180 may be configured to store the types and the output levels of the audio signals output from each of the plurality of audio outputting units 140-1, 140-2, . . . , **140-*n* in a map table form. The controller 150 may be configured to change the types and the output levels of the audio signals output from the plurality of audio outputting units 140-1, 140-2, . . . , 140-*n* based on one of a plurality of set information stored in the storing unit 180** when the user command for selecting the output mode is input or a preset event (e.g., an event in which a voice call is connected during listening to the music) occurs.

Figure 7:
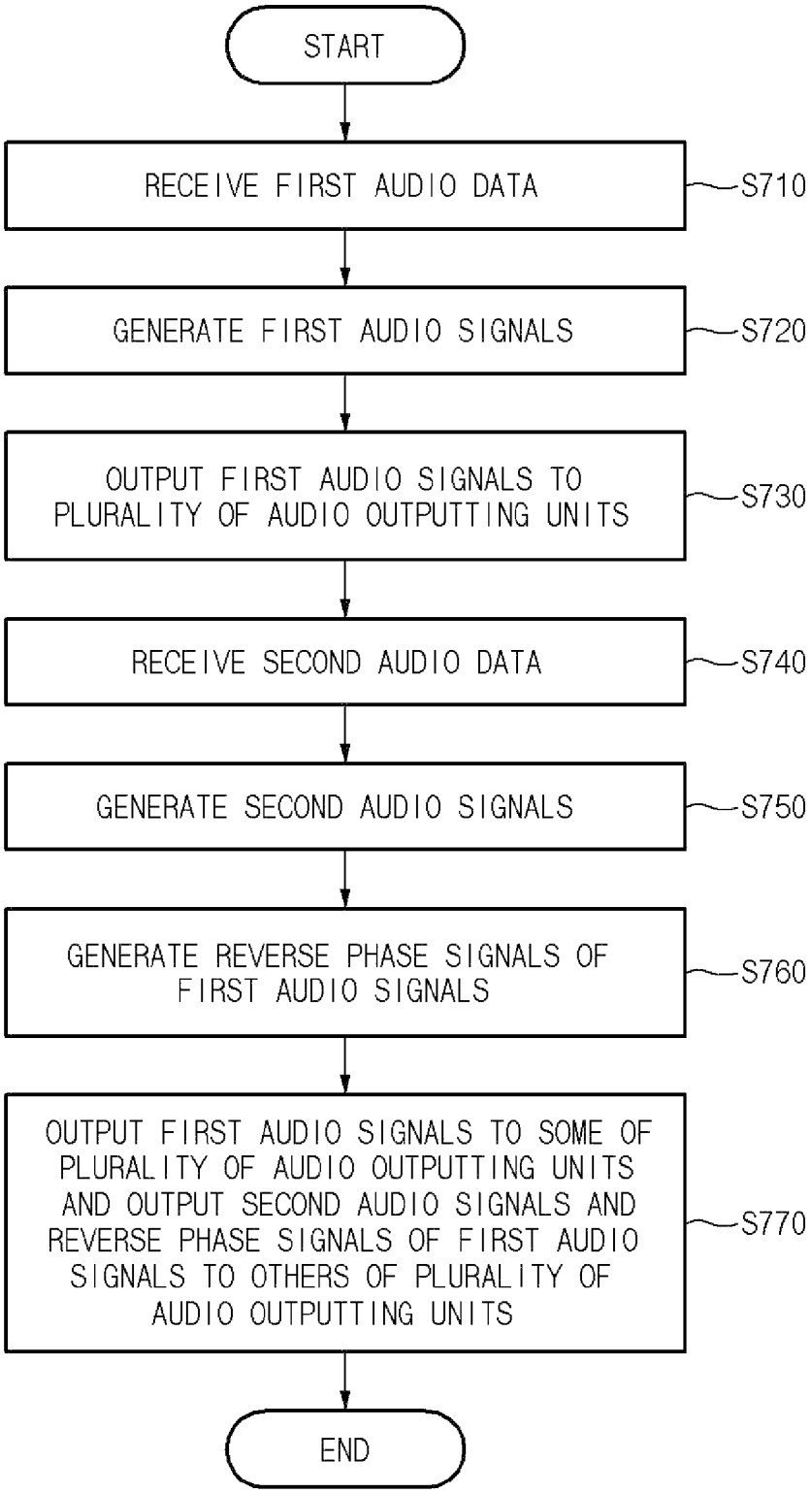
FIG. 7 is an exemplary flow chart for describing a controlling method of an audio apparatus for a vehicle according to an exemplary embodiment of the present disclosure.

FIG. 7 is an exemplary flow chart for describing a controlling method of an audio apparatus for a vehicle according to an exemplary embodiment of the present disclosure. Referring to FIG. 7, the audio apparatus 100 for a vehicle may be configured to first receive the first audio data (S710). Then, the audio apparatus 100 for a vehicle may be configured to process the first audio data to generate the first audio signals (S720). The audio apparatus 100 for a vehicle may be configured to output the audio signals to the plurality of audio outputting units (S730).

Further, the audio apparatus 100 for a vehicle may be configured to receive the second audio data (S740). When the audio apparatus 100 for a vehicle receives the second audio data, the second audio data may be processed (e.g., signal-processed) to generate the second audio signals (S750). The audio apparatus 100 for a vehicle may further be configured to generate the reverse phase signals of the first audio signals (S760) and output the first audio signals to some of the plurality of audio outputting units (e.g., a first group) and output the second audio signals and the reverse phase signals of the first audio signals to others thereof (S770) (e.g., a second group).

Meanwhile, when the second audio signals are generated, the reverse phase signals of the second audio signals may also be generated. In addition, the reverse phase signals of the second audio signal may be output together with the first audio signals from the audio outputting units outputting the first audio signal. In particular, types of audio signals and reverse phase signals output from the plurality of audio outputting units positioned within the vehicle may be changed based on a user situation. Since this has been described with reference to FIGS. 2 and 4, a detailed description thereof will be omitted.

In addition, the reverse phase signals of the first audio signals and the reverse phase signals of the second audio signals may be output at output levels lower than those of the first audio signals and the second output levels to prevent all of the audio signals from being offset by the reverse phase signals when the output levels of the reverse phase signals of the audio signals are equal to or greater than those of the audio signals, such that the audio signals may not be heard. In addition, the output levels of the reverse phase signals output from the audio outputting units may be different from each other based on positions of the plurality of audio outputting units within the vehicle.

Moreover, the audio apparatus 100 for a vehicle may be configured to receive the user command for changing the audio signals output from the plurality of audio outputting units. In particular, the audio apparatus 100 for a vehicle may be configured to receive the user command for changing the types and the output levels of the audio signals output from the plurality of audio outputting units. In addition, the audio apparatus 100 for a vehicle may be configured to change the audio signals output from the plurality of audio outputting units based on the user command. The audio apparatus 100 for a vehicle may be configured to receive the user command for selecting the output mode in which the types and the output levels of the audio signals output from each of the plurality of audio outputting units are set. In addition, the audio apparatus 100 for a vehicle may be configured to change the audio signals output from the plurality of audio outputting units based on the selected output mode.

As set forth above, according to various exemplary embodiments of the present disclosure, passengers may listen to different audio signals based on their positions within a vehicle, thus, increasing user convenience. In addition, the passengers may listen to an audio signal without being hindered by audio signals output from other seats (e.g., when a call is received in another area of the vehicle). Further, in the case of a voice call, a passenger may make a private call without exposing call contents to passengers seated on other seats.

Although exemplary embodiments of the present disclosure have been shown and described hereinabove, the present disclosure is not limited to exemplary embodiments described above, but may be various modified by those skilled in the art to which the present disclosure pertains without departing from the scope and spirit of the disclosure as disclosed in the accompanying claims. In addition, such modifications should also be understood to fall within the scope and spirit of the present disclosure.

What is claimed is:

1. An audio apparatus comprising:

a memory configured to store program instructions; and a processor configured to execute the program instructions, which when executed cause the processor to:

receive first audio data and second audio data;

process the first audio data and the second audio data to generate first audio signals and second audio signals;

generate reverse phase signals of the first audio signals;

generate reverse phase signals of the second audio signals;

output the first audio signals and the reverse phase signals of the second audio signals together through a first group of audio outputting units; and output the second audio signals and the reverse phase signals of the first audio signals through a second group of audio outputting units, wherein output levels of the reverse phase signals of the first audio signals are different from each other based on positions of the audio outputting units that output the reverse phase signals of the first audio signals.

2. The audio apparatus according to claim 1, wherein the output levels of the reverse phase signals of the first audio signals are lower than those of the first audio signals.

3. The audio apparatus according to claim 1, wherein the program instructions when executed are further configured to:

display types of audio signals output from each of the plurality of audio outputting units using a display unit.

4. The audio apparatus according to claim 1, wherein the program instructions when executed are further configured to:

receive a user command for changing audio signals output from the plurality of audio outputting units using an inputting unit.

5. The audio apparatus according to claim 1, wherein the program instructions when executed are further configured to:

store set information in which types and output levels of audio signals output from each of the plurality of audio outputting units are set.

6. A controlling method of an audio apparatus, comprising:

receiving, by a controller, first audio data;

processing, by the controller, the first audio data to generate first audio signals;

outputting, by the controller, the first audio signals to a plurality of audio outputting units;

receiving, by the controller, second audio data;

processing, by the controller, the second audio data to generate second audio signals;

generating, by the controller, reverse phase signals of the first audio signals;

generating, by the controller, reverse phase signals of the second audio signals;

outputting, by the controller, the first audio signals and the reverse phase signals of the second audio signals together to a first group of the plurality of audio outputting units; and outputting, by the controller, the second audio signals and the reverse phase signals of the first audio signals to a second group of the plurality of audio outputting units, wherein output levels of the reverse phase signals of the first audio signals are different from each other based on positions of the audio outputting units that output the reverse phase signals of the first audio signals.

7. The controlling method of an audio apparatus according to claim 6, wherein in the outputting of the reverse phase signals of the first audio signals, the reverse phase signals of the first audio signals are output at output levels lower than those of the first audio signals.

8. The controlling method of an audio apparatus according to claim 6, further comprising:

receiving, by the controller, a user command for changing audio signals output from the plurality of audio outputting units; and changing, by the controller, the audio signals output from the plurality of audio outputting units based on the user command.

9. The controlling method of an audio apparatus according to claim 6, further comprising:

receiving, by the controller, a user command for selecting an output mode in which types and output levels of audio signals output from each of the plurality of audio outputting units are set; and changing, by the controller, the audio signals output from the plurality of audio outputting units based on the output mode.

10. A non-transitory computer readable medium containing program instructions executed by a controller, the computer readable medium comprising:

program instructions that receive first audio data;

program instructions that process the first audio data to generate first audio signals;

program instructions that output the first audio signals to a plurality of audio outputting units;

program instructions that receive second audio data;

program instructions that process the second audio data to generate second audio signals;

program instructions that generate reverse phase signals of the first audio signals;

program instructions that generate reverse phase signals of the second audio signals;

program instructions that output the first audio signals and the reverse phase signals of the second audio signals together to a first group of the plurality of audio outputting units; and program instructions that output the second audio signals and the reverse phase signals of the first audio signals to a second group of the plurality of audio outputting units, wherein output levels of the reverse phase signals of the first audio signals are different from each other based on positions of the audio outputting units that output the reverse phase signals of the first audio signals.

11. The non-transitory computer readable medium of claim 10, wherein in the outputting of the reverse phase signals of the first audio signals, the reverse phase signals of the first audio signals are output at output levels lower than those of the first audio signals.

12. The non-transitory computer readable medium of claim 10, further comprising:

program instructions that receive a user command for changing audio signals output from the plurality of audio outputting units; and program instructions that change the audio signals output from the plurality of audio outputting units based on the user command.

13. The non-transitory computer readable medium of claim 10, further comprising:

program instructions that receive a user command for selecting an output mode in which types and output levels of audio signals output from each of the plurality of audio outputting units are set; and program instructions that change the audio signals output from the plurality of audio outputting units based on the output mode.

* * * * *